US009193424B2

(12) United States Patent
Lee

(10) Patent No.: US 9,193,424 B2
(45) Date of Patent: Nov. 24, 2015

(54) MANNED SUBMARINE FOR UNDERWATER VIEWING AND EXPERIENCE

(71) Applicant: PACIFIC OCEAN MARINE INDUSTRY CO., LTD., Busan-si (KR)

(72) Inventor: Hyo Jin Lee, Busan-si (KR)

(73) Assignee: PACIFIC OCEAN MARINE INDUSTRY CO., LTD., Busan-Si (KR)

( * ) Notice: Subject to any disclaimer, the term of this patent is extended or adjusted under 35 U.S.C. 154(b) by 2 days.

(21) Appl. No.: 14/163,977

(22) Filed: Jan. 24, 2014

(65) Prior Publication Data

US 2015/0210368 A1 Jul. 30, 2015

(51) Int. Cl.

| | |
|---|---|
| ***B63C 11/38*** | (2006.01) |
| ***B63C 11/49*** | (2006.01) |
| ***B63G 8/00*** | (2006.01) |
| ***B63G 8/04*** | (2006.01) |
| ***B63G 8/08*** | (2006.01) |
| ***B63G 8/14*** | (2006.01) |
| ***B63G 8/38*** | (2006.01) |
| ***B63G 8/36*** | (2006.01) |

(52) U.S. Cl.

CPC *B63G 8/001* (2013.01); *B63G 8/04* (2013.01); *B63G 8/08* (2013.01); *B63G 8/14* (2013.01); *B63G 8/36* (2013.01); *B63G 8/38* (2013.01)

(58) Field of Classification Search

CPC ..... B63C 11/38; B63C 11/49
USPC ..... 114/66, 312
See application file for complete search history.

(56) References Cited

U.S. PATENT DOCUMENTS

| | | | | |
|---|---|---|---|---|
| 3,527,184 | A * | 9/1970 | McCarty et al. | 114/331 |
| 3,598,074 | A * | 8/1971 | Schubert | 114/325 |
| 4,494,472 | A * | 1/1985 | Rougerie | 114/66 |
| 4,809,630 | A * | 3/1989 | Walker | 114/66 |
| 4,928,614 | A * | 5/1990 | Forman | 114/66 |
| 4,938,164 | A * | 7/1990 | Onofri | 114/312 |
| 5,067,427 | A * | 11/1991 | Kobayashi | 114/61.3 |
| 5,704,309 | A * | 1/1998 | Kohnen | 114/312 |
| 6,058,848 | A * | 5/2000 | Futami et al. | 104/71 |
| 6,321,676 | B1 * | 11/2001 | Kohnen et al. | 114/312 |
| 7,246,566 | B2 * | 7/2007 | Marion | 114/312 |
| 7,856,938 | B2 * | 12/2010 | Marion et al. | 114/312 |
| 8,869,724 | B2 * | 10/2014 | von der Goltz | 114/66 |

* cited by examiner

*Primary Examiner* — S. Joseph Morano
*Assistant Examiner* — Jovon Hayes
(74) *Attorney, Agent, or Firm* — IM IP Law PLLC; C. Andrew Im

(57) ABSTRACT

A manned submarine for underwater viewing and experience. A viewing window through which an outside view can be seen is disposed above the body of the submarine. The viewing window has an internal space and is open in the lower portion thereof. The propulsion systems provides a propelling force to the body. The ascending and descending system allows the manned submarine to ascend on the water or to descend under the water. The control box disposed at the forecastle of the body controls the operations of the propulsion systems, and the ascending and descending system. The viewing window is disposed above the crew room and is configured to allow water to enter the crew room except the internal space of the viewing window to allow the passengers to breathe underwater and provide a high level of leisure experience in addition to the visual viewing experience.

3 Claims, 12 Drawing Sheets

MANNED SUBMARINE FOR UNDERWATER VIEWING AND EXPERIENCE

TECHNICAL FIELD

The present invention relates to a manned submarine for underwater viewing and experience, and more particularly, to a manned submarine for underwater viewing and experience that has a viewing window disposed above a crew room where passengers get into, through which an outside view can be seen, thus allowing the passengers to effectively view the surrounding environment, and that is configured to allow water to enter the crew room except the internal space of the viewing window in which the upper bodies of the passengers are located to breathe underwater, thus making the water brought into contact with the bodies of the passengers to provide a high level of leisure experience capable of stimulating their five senses, not to provide simple visual viewing.

BACKGROUND OF THE INVENTION

Generally, a submarine has a forecastle and a poop and further has a crew room formed at the interior thereof so as to hold passengers thereinto. So as to allow the passengers to get into the crew room, furthermore, a hatch is provided on the upper portion of the submarine. Typically, the submarine has been used for underwater infiltration or vehicle.

With the development of leisure culture, recently, the submarine is also used for underwater viewing, but since the crew room where passengers get into is closed from the outside, simple visual viewing is provided to the submarine for underwater viewing, thus making a level of leisure experience substantially low.

Further, the hatch is disposed on the upper portion of the submarine and necessarily fixed to the submarine, so that in the state where the passengers get into the submarine their visual viewing space is restricted to provide a substantially low level of leisure experience.

Accordingly, there is a definite need for the development of a manned submarine capable of providing a high level of underwater viewing and experience to passengers.

OBJECT AND SUMMARY OF THE INVENTION

Accordingly, the present invention has been made in view of the above-mentioned problems occurring in the prior art, and it is an object of the present invention to provide a manned submarine for underwater viewing and experience that has a viewing window disposed above a crew room where passengers get into, through which an outside view can be seen, thus allowing the passengers to effectively view the surrounding environment, and that is configured to allow water to enter the crew room except the internal space of the viewing window in which the upper bodies of the passengers are located to breathe underwater, thus making the water brought into contact with the bodies of the passengers to provide a high level of leisure experience capable of stimulating their five senses, not to provide simple visual viewing.

It is another object of the present invention to provide a manned submarine for underwater viewing and experience that is configured wherein a body and a viewing window are spaced apart from each other to allow passengers to go into and come from the space therebetween, so that during underwater viewing they put on their scuba set and easily experience scuba diving, thus providing a high level of leisure experience to them.

To accomplish the above-mentioned objects, according to the present invention, there is a manned submarine for underwater viewing and experience having a body on which a forecastle and a poop are formed and a crew room formed on the top portion of the body to allow crew members and passengers to get thereinto, the manned submarine including: a viewing window through which an outside view is seen disposed above the body in such a manner as to be spaced apart from the body, the viewing window having an internal space thereinto and being open in the lower portion thereof; fixing means adapted to firmly fix the viewing window to the body; propulsion systems adapted to provide a propelling force to the body; an ascending and descending system adapted to allow the manned submarine to ascend on the water or to descend under the water; and a control box disposed at the forecastle of the body to control the operations of the propulsion systems and the ascending and descending system, wherein each fixing means includes: an inside frame disposed along the inner surface of the viewing window and having one end fixed to one side of the body and the other end fixed to the other side of the body, the inside frame having support protrusions formed protrudingly on the outside surface thereof in such a manner as to come into contact with the lower portion of the viewing window and to support the viewing window thereagainst; and an outside frame disposed along the outer surface of the viewing window and having one end fixed to one side of the body and the other end fixed to the other side of the body, the outside frame being laminated on the inside frame so as to prevent the viewing window supported by the inside frame from being escaped from the body.

According to the present invention, desirably, each propulsion system includes: a driving motor adapted to provide a rotary force; a propeller rotated by receiving the rotary force from the driving motor; a casing into which the driving motor and the propeller are embedded; a rotary shaft having one end connected to the casing and the other end connected to the body; a pinion gear located at one end of the rotary shaft in such a manner as to be rotated together with the rotary shaft; a rack gear geared with the pinion gear to rotate the pinion gear; and a rotating cylinder having a rod coupled to one end of the rack gear in such a manner as to move the rack gear forward and backward, and wherein at least one or more propulsion systems are disposed on both sides of the body, respectively, and the driving motor and the rotating cylinder of each propulsion system are operated by the control of the control box.

According to the present invention, desirably, the manned submarine for underwater viewing and experience further includes an oxygen supply system adapted to measure the oxygen concentration at the interior of the viewing window and to supply oxygen to maintain an appropriate oxygen concentration, thus allowing the passengers in the crew room formed on the upper side of the body to stably breathe underwater, and the oxygen supply system includes: an oxygen concentration measuring sensor disposed inside the viewing window so as to measure the oxygen concentration at the interior of the viewing window and to send the measured information to the control box; a second oxygen tank adapted to supply oxygen to the interior of the viewing window; an oxygen discharge tube adapted to communicate with the second oxygen tank and discharge the oxygen supplied from the second oxygen tank to the interior of the viewing window; and an opening/closing valve disposed on the oxygen discharge tube so as to determine whether the interior of the oxygen discharge tube is open or closed, the opening/closing valve being operated by the control of the control box.

According to the present invention, the manned submarine for underwater viewing and experience has the viewing window disposed above the crew room where the passengers get into, through which an outside view can be seen, thus allowing the passengers to effectively view the surrounding environment, and that is configured to allow water to enter the crew room except the internal space of the viewing window in which the upper bodies of the passengers are located to breathe underwater, thus making the water brought into contact with the bodies of the passengers to provide a high level of leisure experience capable of stimulating their five senses, not to provide simple visual viewing.

In addition, the manned submarine for underwater viewing and experience is configured wherein the body and the viewing window are spaced apart from each other to allow passengers to go into and come from the space therebetween, so that during underwater viewing they put on their scuba set and easily experience scuba diving, thus providing a high level of leisure experience to them.

DETAILED DESCRIPTION OF THE EMBODIMENTS

Hereinafter, an explanation on a manned submarine for underwater viewing and experience according to a preferred embodiment of the present invention will be in detail given with reference to the attached drawings.

Figure 1:
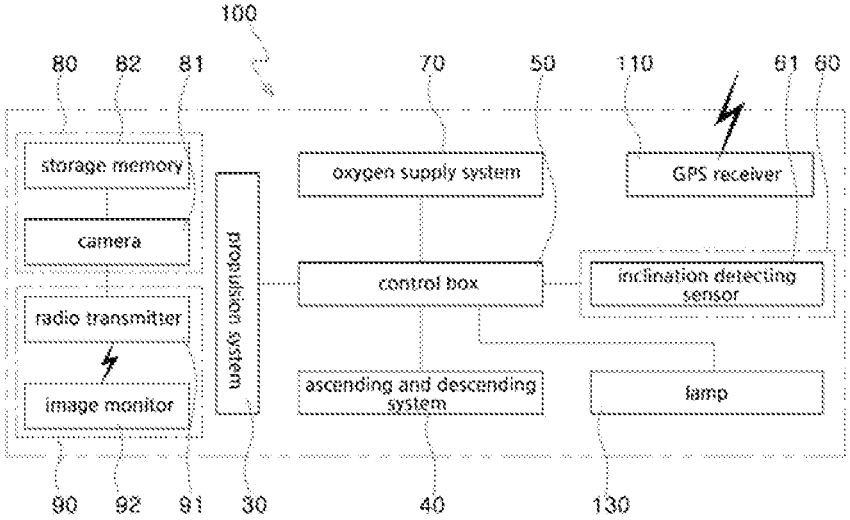
FIG. 1 is a block diagram showing the configuration of a manned submarine for underwater viewing and experience according to the present invention.
Figure 2:
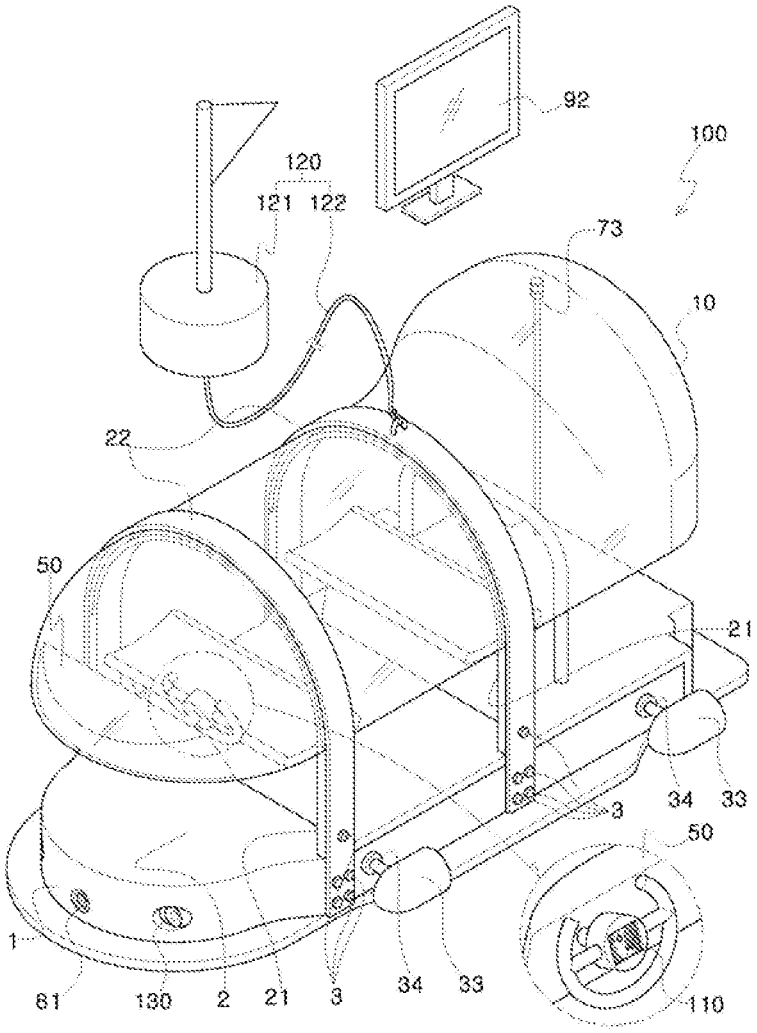
FIG. 2 is a perspective view showing the manned submarine for underwater viewing and experience of FIG. 1.
Figure 3:
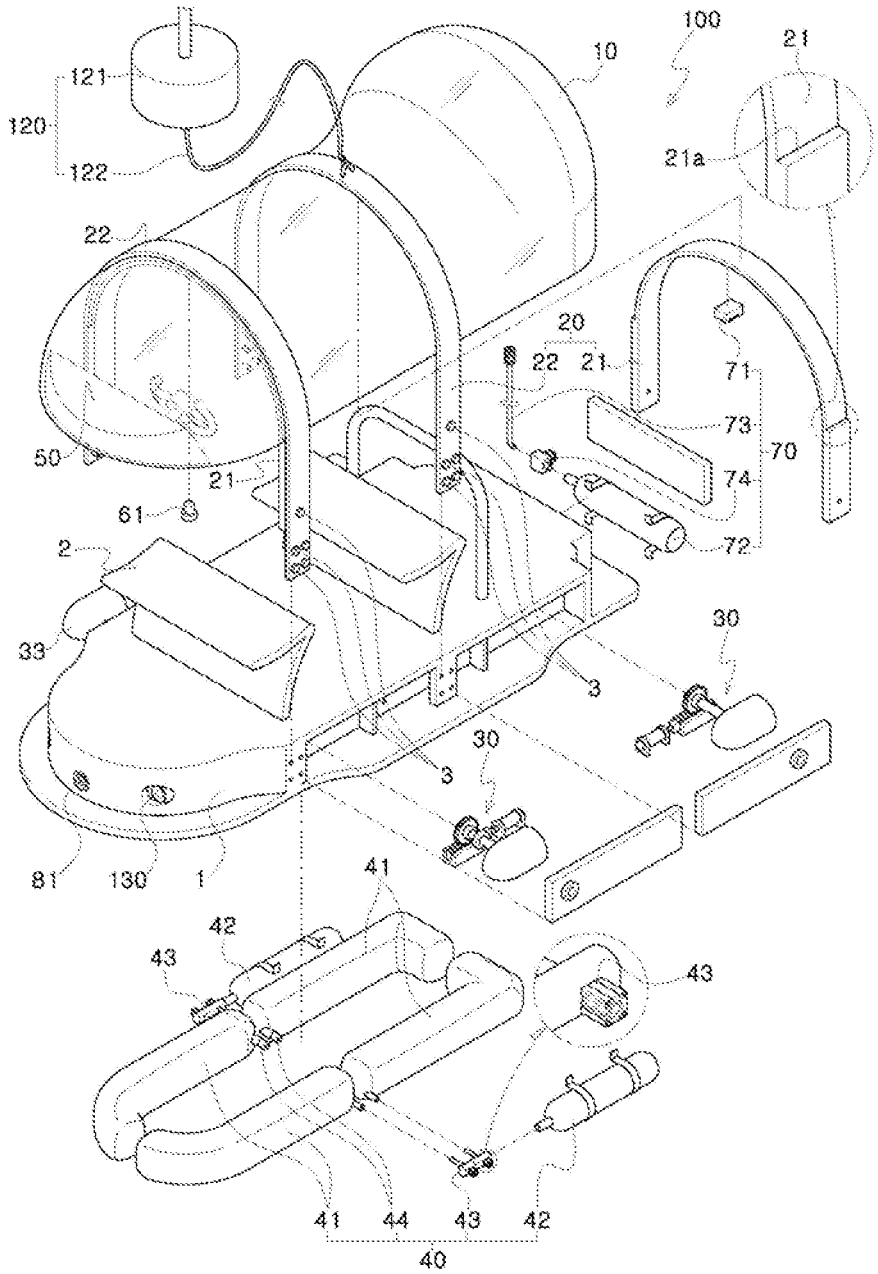
FIG. 3 is an exploded perspective view showing the manned submarine for underwater viewing and experience of FIG. 1.
Figure 4:
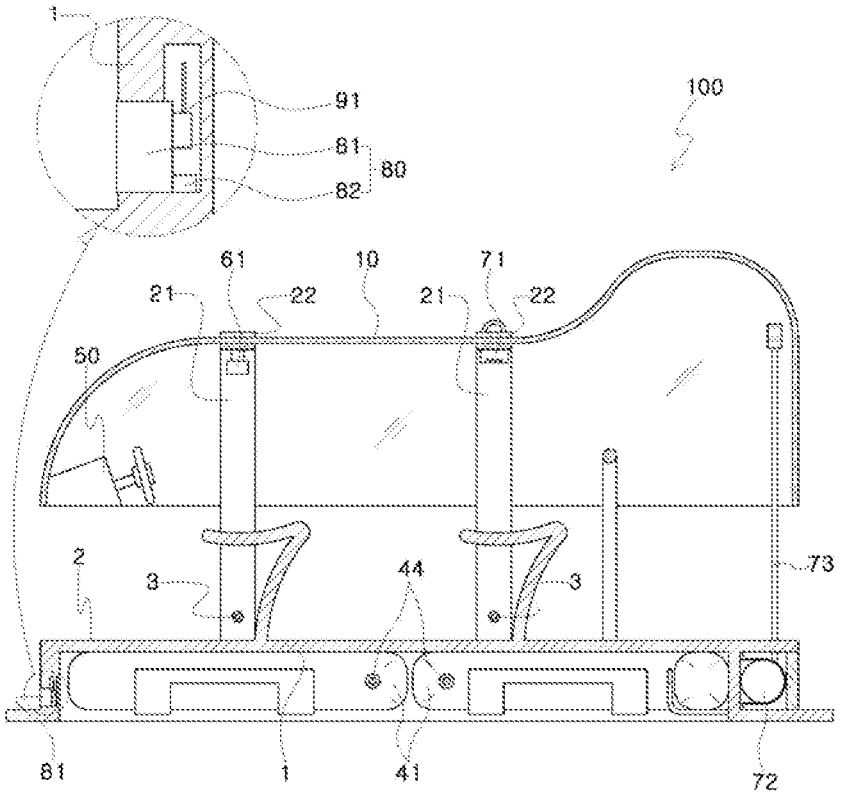
FIG. 4 is a vertical sectional view showing the manned submarine for underwater viewing and experience of FIG. 1.
Figure 5:
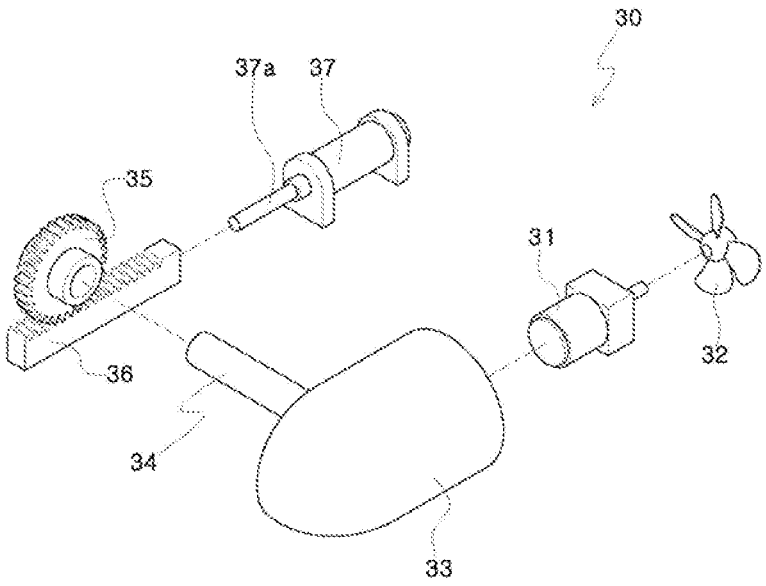
FIG. 5 is a separate perspective view showing a propulsion system of the manned submarine for underwater viewing and experience of FIG. 1.

FIGS. 1 to 6 show a manned submarine for underwater viewing and experience according to the present invention, wherein FIG. 1 is a block diagram showing the configuration of the manned submarine for underwater viewing and experience, FIG. 2 is a perspective view showing the manned submarine for underwater viewing and experience of FIG. 1, FIG. 3 is an exploded perspective view showing the manned submarine for underwater viewing and experience of FIG., FIG. 4 is a vertical sectional view showing the manned submarine for underwater viewing and experience of FIG. 1, FIG. 5 is a separate perspective view showing a propulsion system of the manned submarine for underwater viewing and experience of FIG. 1, and FIGS. 6*a* to 6*h* are sectional views showing the use states of the manned submarine for underwater viewing and experience of FIG. 1.

As shown, the manned submarine 100 for underwater viewing and experience according to the present invention includes a body 1 on which a forecastle and a poop are formed and a crew room 2 formed on the top portion of the body 1 to allow crew members and passengers to get thereinto, and further, the manned submarine 100 includes a viewing window 10, fixing means 20, propulsion systems 30, an ascending and descending system 40, and a control box 50.

As shown in FIGS. 2 to 4, the viewing window 10 is transparent, through which an outside view can be seen, and it is disposed above the body 1 in such a manner as to be spaced apart from the body 1, while having an internal space thereinto and being open in the lower portion thereof.

That is, the viewing window 10 has an internal space thereinto and is open in the lower portion thereof, so that when the manned submarine is submerged, it can protect the invasion of water therefrom to allow the passengers inside the viewing window 10 to stably breathe underwater. Further, as shown in FIG. 6*c*, the viewing window 10 is made of a transparent material to allow the passengers in the crew room 2 to clearly view underwater environment therethrough.

Figure 6A:
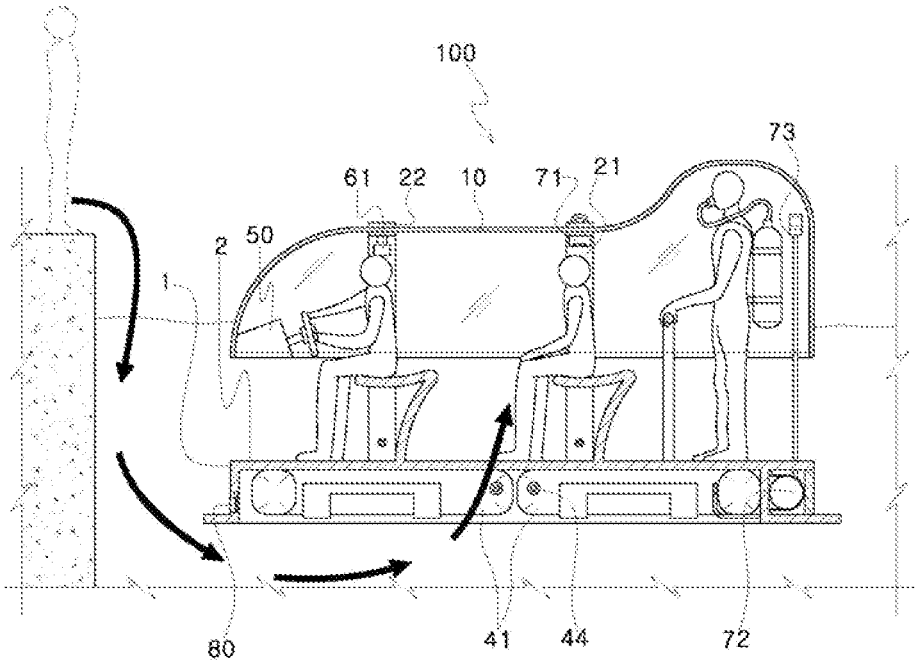
FIGS. 6*a* to 6*h* are sectional views showing the use states of the manned submarine for underwater viewing and experience of FIG. 1.
Figure 6B:
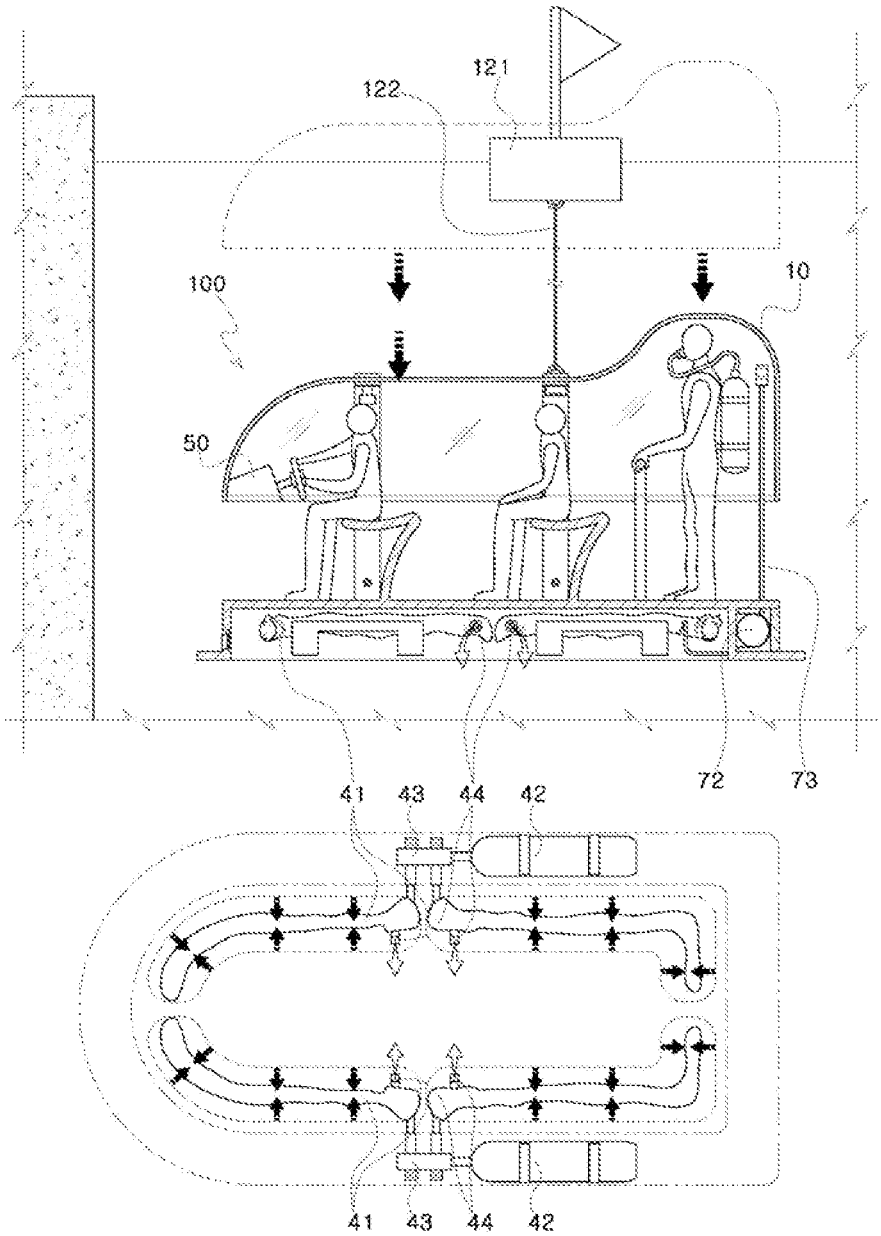
Figure 6C:
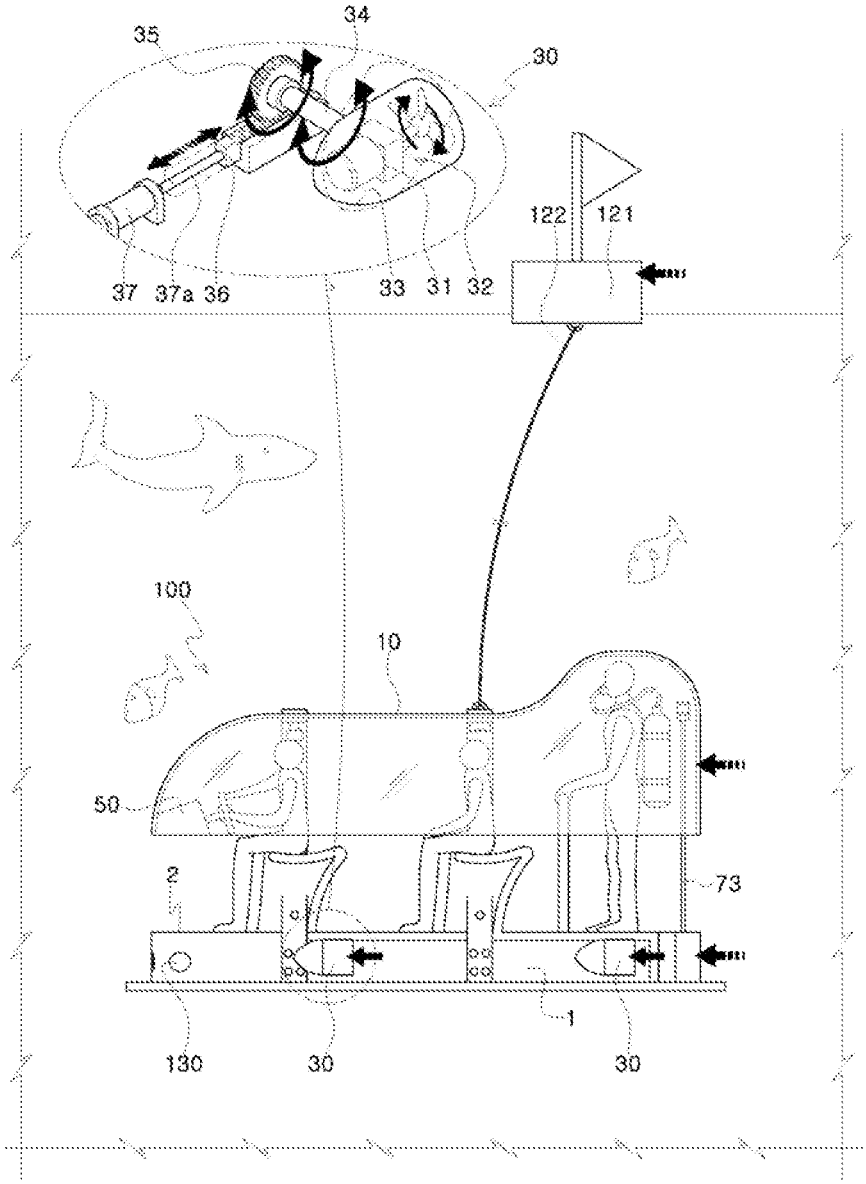

In this case, as shown in FIG. 6*c*, water naturally enters the space formed by the separation between the viewing window 10 and the body 1 and comes into contact with the bodies of the passengers in the crew room 2, thus providing a high level of leisure experience capable of stimulating their five senses, not providing simple visual viewing.

Figure 6D:
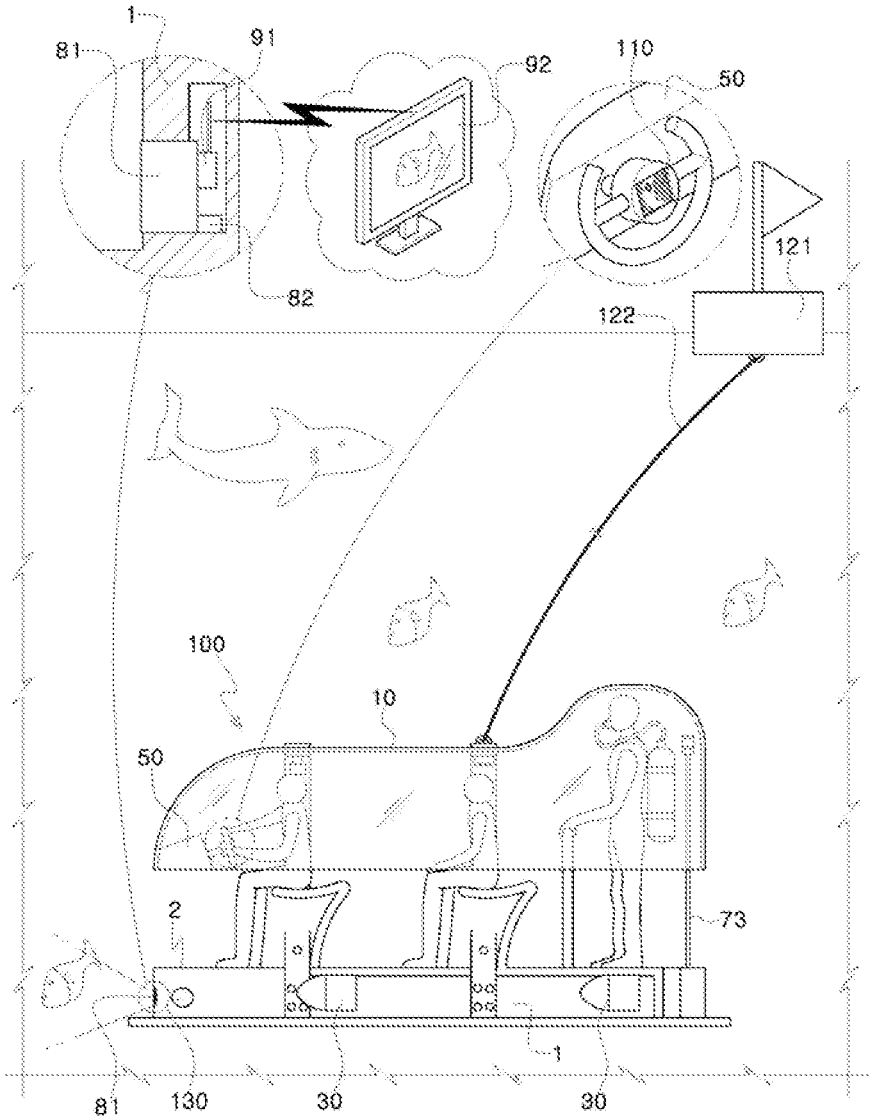
Figure 6E:
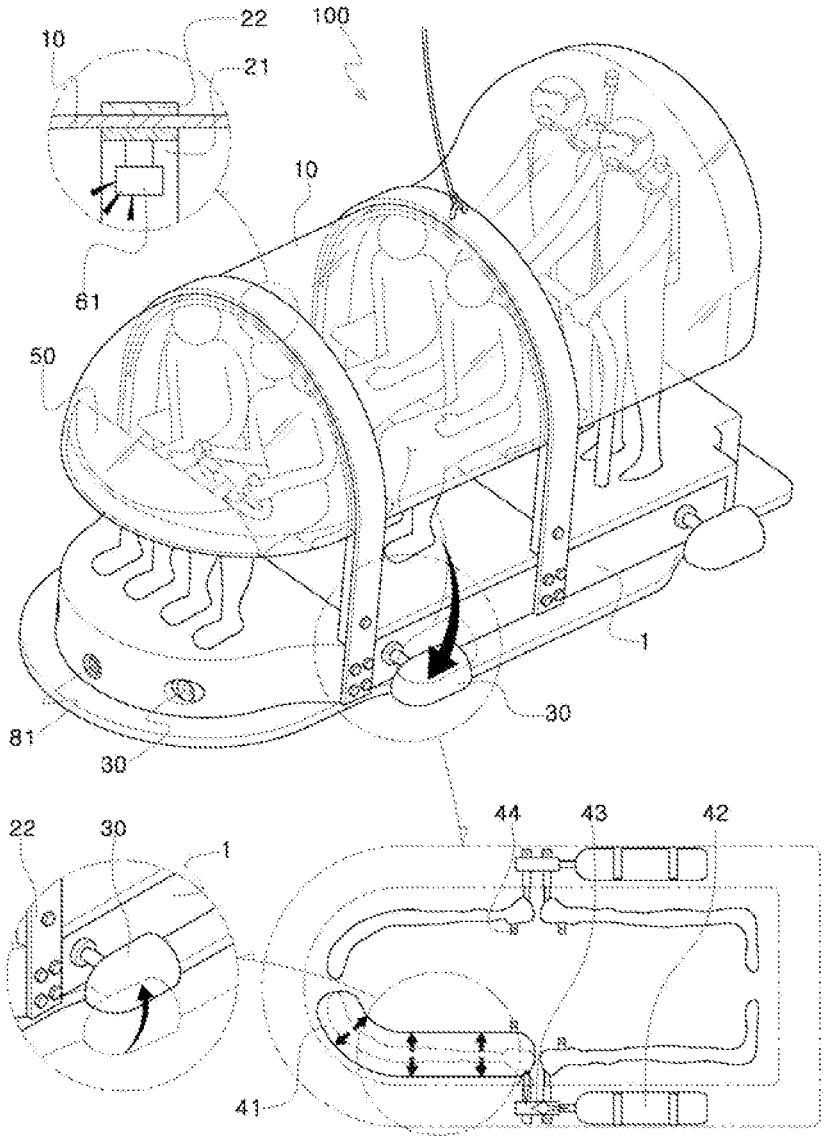
Figure 6F:
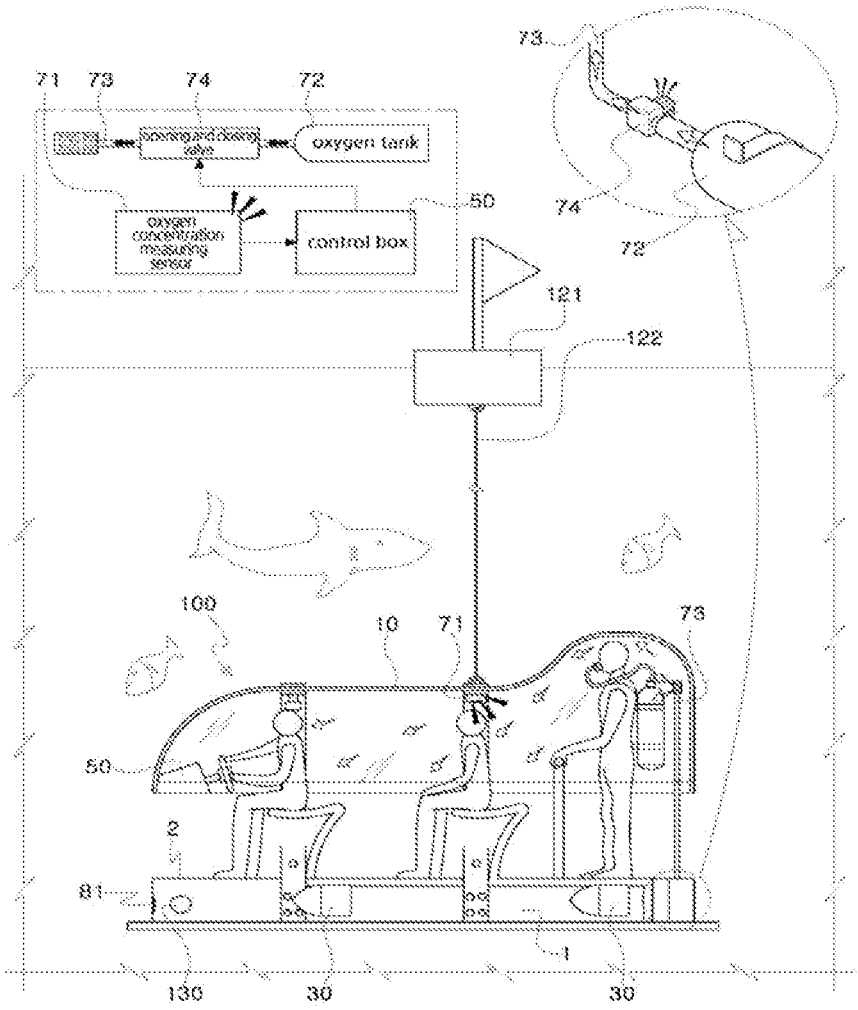
Figure 6G:
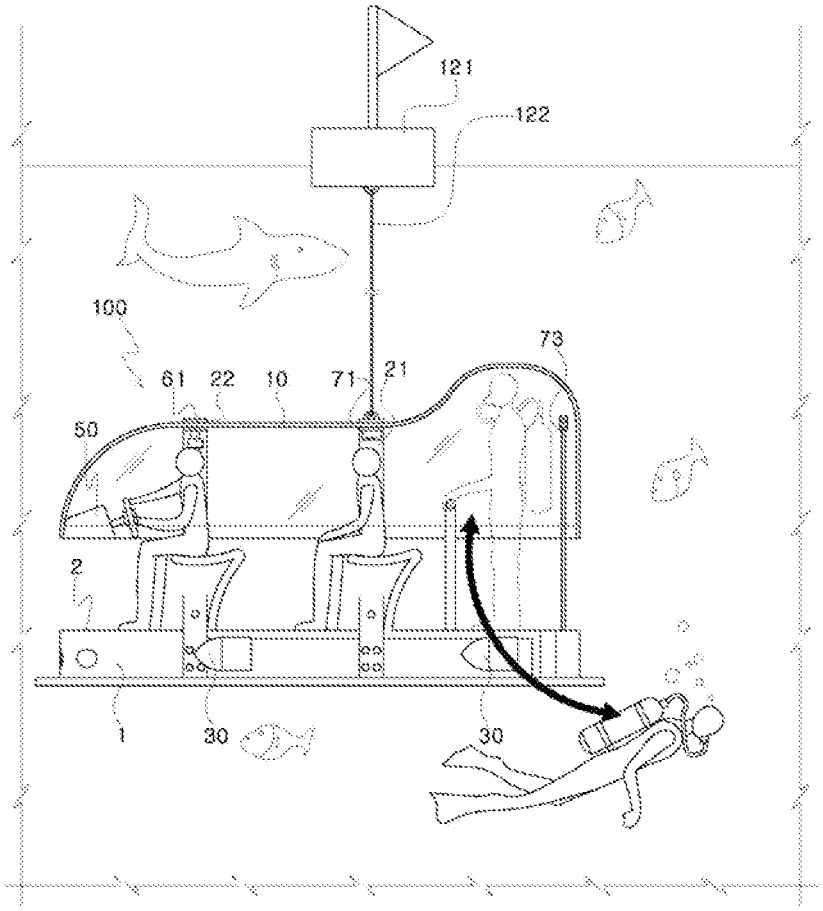

Furthermore, as shown in FIG. 6*g*, passengers can go into and come from the space formed by the separation between the viewing window 10 and the body 1, so that during underwater viewing they put on their scuba set and easily experience scuba diving, thus providing a high level of leisure experience to them.

So as to allow the passengers to stay underwater for a long period of time, on the other hand, the manned submarine 100 according to the present invention further includes an oxygen supply system 70 adapted to measure the oxygen concentration at the interior of the viewing window 10 and to supply oxygen to maintain an appropriate oxygen concentration, so that the passengers in the crew room 2 formed on the upper side of the body 1 can stably breathe underwater.

As shown in FIGS. 1 to 4, the oxygen supply system 70 includes: an oxygen concentration measuring sensor 71 disposed inside the viewing window 10 so as to measure the oxygen concentration at the interior of the viewing window 10 and to send the measured information to the control box 50; a second oxygen tank 72 adapted to supply oxygen to the interior of the viewing window 10; an oxygen discharge tube 73 adapted to communicate with the second oxygen tank 72 and discharge the oxygen supplied from the second oxygen tank 72 to the interior of the viewing window 10; and an opening/closing valve 74 disposed on the oxygen discharge tube 73 so as to determine whether the interior of the oxygen discharge tube 73 is open or closed.

That is, as shown in FIG. 6*f*, the opening/closing valve 74 is continuously open and closed under the control of the control box 50 so as to maintain the appropriate oxygen concentration (in the range from about 20.5% to about 23%), under which the passengers in the crew room 2 can easily breathe, in accordance with the measured information of the oxygen concentration measuring sensor 71. As a result, the oxygen existing in the second oxygen tank 72 is appropriately introduced into the viewing window 10, thus being maintained at the appropriate concentration in the internal space of the viewing window 10.

As shown in FIGS. 2 to 4, each fixing means 20 is adapted to firmly fix the viewing window 10 to the body 1.

Each fixing means 20 includes: an inside frame 21 disposed along the inner surface of the viewing window 10 and having one end fixed to one side of the body 1 and the other end fixed to the other side of the body 1, the inside frame 21 having support protrusions 21*a* formed protrudingly on the outside surface thereof in such a manner as to come into contact with the lower portion of the viewing window 10 and to support the viewing window 10 thereagainst; and an outside frame 22 disposed along the outer surface of the viewing window 10 and having one end fixed to one side of the body 1 and the other end fixed to the other side of the body 1, the outside frame 22 being laminated on the inside frame 21 so as to prevent the viewing window 10 supported by the inside frame 21 from being escaped from the body 1. Of course, the fixing means 20 is not limited in their use by the above-mentioned manner.

In this case, desirably, the inside frame 21 and the outside frame 22 should be firmly fixed to the body 1 by means of bolt coupling 3, but they may be fixed thereto by means of other coupling ways.

As shown in FIGS. 1 to 5, the propulsion systems 30 are adapted to provide a propelling force to the body 1.

Each propulsion system 30 includes: a driving motor 31 adapted to provide a rotary force; a propeller 32 rotated by receiving the rotary force from the driving motor 31; a casing 33 into which the driving motor 31 and the propeller 32 are embedded; a rotary shaft 34 having one end connected to the casing 33 and the other end connected to the body 1; a pinion gear 35 located at one end of the rotary shaft 34 in such a manner as to be rotated together with the rotary shaft 34; a rack gear 36 geared with the pinion gear 35 to rotate the pinion gear 35; and a rotating cylinder 37 having a rod 37*a* coupled to one end of the rack gear 36 in such a manner as to move the rack gear 36 forward and backward. In this case, at least one or more propulsion systems 30 are located on both sides of the body 1, respectively.

That is, as shown in FIG. 6*c*, the propelling force can be generated in various directions through the operations of the driving motor 31 and the rotating cylinder 37 by the control of the control box 50, thus moving the manned submarine 100, changing the moving direction thereof, and stopping the movement, in an easy manner.

Accordingly, the manned submarine 100 of the present invention provides the two propulsion systems 30 on both sides of the body 1, respectively, thus allowing the manned submarine 100 to be moved, being changed in the moving direction thereof, and being stopped, precisely, but the propulsion systems 30 may be located in various manners.

As shown in FIGS. 1, 3 and 4, the ascending and descending system 40 is adapted to allow the manned submarine 100 to ascend on the water or to descend under the water.

The ascending and descending system 40 includes: buoyancy bags 41 embedded into the body 1 and easily contracted and expanded to provide buoyancy to the body 1; first oxygen tanks 42 adapted to communicate with the buoyancy bags 41 to supply oxygen to the interior of the buoyancy bags 41; supply valves 43 disposed on each first oxygen tank 42 to determine whether oxygen is supplied or not from the first oxygen tanks 42 to the buoyancy bags 41; and a discharge valve 44 disposed on each buoyancy bag 41 to determine whether oxygen supplied to the buoyancy bags 41 is discharged or not.

So as to descend the manned submarine 100 according to the present invention, as shown in FIG. 6*b*, the discharge valves 44 are open to discharge the oxygen filled into the buoyancy bags 41 to the outside, thus reducing the buoyancy of the buoyancy bags 41, so that the manned submarine 100 according to the present invention can be naturally descended by means of its own weight.

Figure 6H:
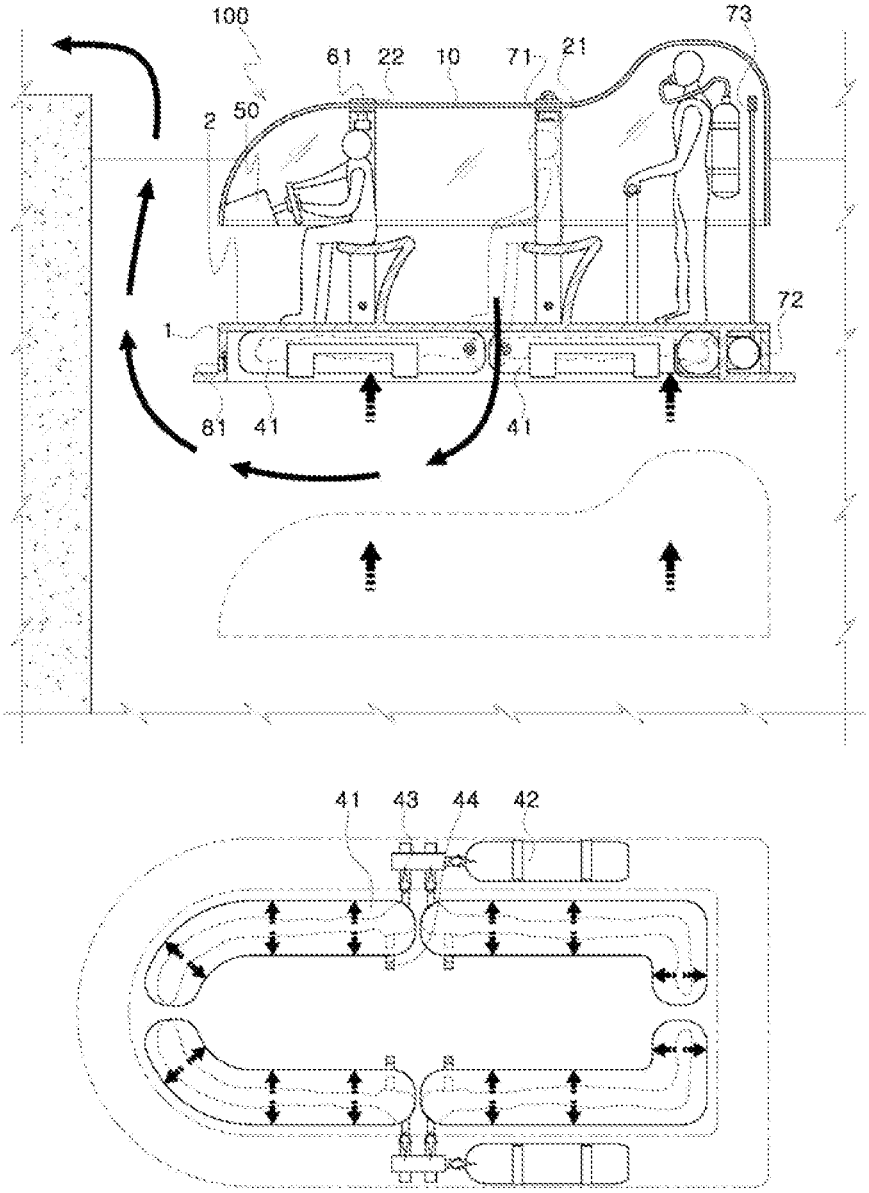

So as to ascend the manned submarine 100 according to the present invention, as shown in FIG. 6*h*, the supply valves 43 are open to allow the oxygen stored in the first oxygen tanks 42 to be filled into the buoyancy bags 41, thus increasing the buoyancy of the buoyancy bags 41, so that the manned submarine 100 according to the present invention can be naturally ascended by means of the increased buoyancy thereof.

At this time, the operations of the supply valves 43 and the discharge valves 44 are performed by means of the control of the control box 50.

If the manned submarine 100 is inclined toward any one side thereof during the underwater driving thereof, in this case, a horizontally maintaining system 60 is further needed to sense the inclination of the manned submarine 100 and to control horizontal maintaining of the body 1, thus desirably ensuring the stability of the manned submarine 100.

As shown in FIGS. 1, 3 and 4, at least one or more buoyancy bags 41 each having the discharge valve 44 formed thereon are disposed on both sides of the body 1, respectively, and at least one or more first oxygen tanks 42 are provided to supply oxygen to the buoyancy bags 41. Also, the supply valves 43 determining the supply of oxygen from the first oxygen tanks 42 to the buoyancy bags 41 are disposed in corresponding number to the number of buoyancy bags 41, thus individually supplying oxygen to the buoyancy bags 41.

In this configuration, the horizontally maintaining system 60 has an inclination detecting sensor 61 disposed on the body 1 or the viewing window 10 so as to sense the inclination of the body 1 and to send the sensed information to the control box 50.

That is, if the inclination of the manned submarine 100 while being run is sensed by means of the control box 50 in accordance with the sensed information of the inclination detecting sensor 61, as shown in FIG. 6*e*, the supply valves 43 are open by means of the control box 50 to supply oxygen to the buoyancy bag 41 located at the inclined side, thus increasing the buoyancy of the buoyancy bag 41, so that the inclination of the manned submarine 100 is appropriately offset and the horizontal state thereof is stably maintained.

As shown in FIGS. 1 to 4, the control box 50 is disposed at the forecastle of the body 1 to control the operations of the propulsion systems 30, the ascending and descending system 40, the horizontally maintaining system 60, and the oxygen supply system 70.

Further, as shown in FIGS. 1 to 4, a photographing system 80 is provided to photograph the surroundings on one side or various sides of the body 1 and to save the photographed information, so that if safety accidents happen, the reasons of the accidents can be easily found.

Desirably, the photographing system 80 includes: at least one or more cameras 81 adapted to photograph the surroundings on one side or various sides of the body 1; and a storage memory 82 electrically connected to the cameras 81 so as to save the photographed information of the cameras 81 thereinto.

According to the present invention, one of the cameras 81 of the manned submarine 100 is embedded into the front surface of the body 1, but the number of the cameras 81 is not limited therein.

In this case, the manned submarine 100 of the present invention further includes a real time monitoring system 90 adapted to in real time receive and monitor the image information photographed through the cameras 81 of the photographing system 80.

As shown in FIGS. 1 and 4, the real time monitoring system 90 includes: a radio transmitter 91 adapted to receive the image information photographed by the cameras 81 and to transmit the received image information to the outside; and an image monitor 92 adapted to receive the image information transmitted from the radio transmitter 91 and to output the received image information as an image.

Accordingly, as shown in FIG. 6*d*, the underwater running state of the manned submarine 100 can be monitored through the image monitor 92 disposed at the outside, thus more strengthening and ensuring the safety of the passengers.

Further, as shown in FIGS. 1 to 3, the manned submarine 100 according to the present invention includes a GPS receiver 110 disposed on the control box 50 so as to receive a signal from a GPS and to sense the current position of the manned submarine 100, so that a driver of the manned submarine 100 can drive the manned submarine 100 to a safe place, while recognizing the current position of the manned submarine 100, thus easily ensuring the safety of the passengers.

Further, as shown in FIGS. 2 and 3, the current position of the manned submarine 100 can be easily recognized from the outside with the eyes.

Therefore, the manned submarine 100 according to the present invention further includes recognizing means 120 having a floating marker 121 floating on the water and easily recognizable by the eyes of people and a rope 122 adapted to connect the floating marker 121 with the body 1 or the fixing means 20 so as to move the floating marker 121 together with the manned submarine 100, so that the current position of the manned submarine 100 being run can be recognized in real time to allow safety accidents to be rapidly treated, thus easily ensuring the safety of the passengers.

Further, as shown in FIGS. 1 to 3, the body 1 has at least one or more lighting lamps 130 embedded on the side surface thereof to allow the driver to easily recognize the surrounding environment, thus previously preventing the manned submarine 100 from colliding against an obstacle during the running process.

In this case, the lighting lamps 130 are of course operated by means of the control of the control box 50.

Under the above-mentioned configuration of the manned submarine 100 according to the present invention, the viewing window 10 through which the outside view can be seen is disposed above the crew room 2 into which the passengers get, thus effectively viewing the surroundings of the manned submarine 100, and further, water enters the entire crew room 2 except the internal space of the viewing window 10 in which the upper bodies of the passengers are located to breathe underwater, thus coming into contact with the bodies to provide a high level of leisure experience capable of stimulating their five senses, not providing simple visual viewing.

Further, the body 1 and the viewing window 10 are isolated from each other, and the passengers can easily go into and come from the space between the body 1 and the viewing window 10, so that during underwater viewing they put on their scuba set and easily experience scuba diving, thus providing a high level of leisure experience to them.

Furthermore, the occurrence of safety accidents can be in advance prevented through the horizontally maintaining system 60, the oxygen supply system 70, the real time monitoring system 90, the GPS receiver 110, and the recognizing means 120, and further, the safety accidents occurring can be rapidly treated, thus effectively ensuring the safety of the passengers.

According to the present invention, the manned submarine 100 is operated by the following order, thus providing underwater viewing and experience to the passengers.

First, as shown in FIG. 6*a*, the buoyancy of the buoyancy bags 41 is increased through the ascending and descending system 40 to locate the manned submarine 100 on water, thus allowing the passengers to easily get into the crew room 2 of the manned submarine 100. If the manned submarine 100 is submerged again in the state of being completely exposed to the outside, a lot of power should be needed, and accordingly, the passengers get into the crew room 2 through the space between the body 1 and the viewing window 10, while the area of ⅔ of the viewing window 10 is being exposed to the outside from the water.

After that, as shown in FIG. 6*b*, if boarding is finished, the buoyancy of the buoyancy bags 41 is decreased through the ascending and descending system 40, thus allowing the manned submarine 100 to be naturally descended by means of its own weight.

At this time, the lighting lamps 130 are turned on to allow the underwater surrounding environment to be easily recognized.

After that, if the descending operation of the manned submarine 100 is finished, as shown in FIG. 6*c*, underwater running starts through the operations of the propulsion systems 30, and the passengers can easily view the surrounding environment through the viewing window 10.

At this time, water naturally enters the space formed between the viewing window 10 and the body 1 and comes into contact with the bodies of the passengers, thus providing a high level of leisure experience capable of stimulating their five senses, not providing simple visual viewing.

In this case, as shown in FIG. 6*c*, the floating marker 121 of the recognizing means 120 is moved together with the manned submarine 100 on water, thus allowing the current position of the manned submarine 100 to be easily recognized from the outside.

Further, as shown in FIG. 6*d*, the surrounding environment of the manned submarine 100 can be photographed and saved through the photographing system 80 while the manned submarine 100 is running, and besides, the image information photographed in the photographing system 80 is checked and monitored to the outside through the image monitor 92 of the real time monitoring system 90.

If the manned submarine 100 is inclined toward any one side thereof during the underwater running, on the other hand, the inclination of the manned submarine 100 can be sensed through the horizontally maintaining system 60, as shown in FIG. 6*e*, and oxygen is supplied to the buoyancy bag 41 located at the inclined side by the control of the control box 50, thus increasing the buoyancy of the buoyancy bag 41, so that the inclination of the manned submarine 100 is appropriately offset and the horizontal state thereof is stably maintained.

On the other hand, as shown in FIG. 6*f*, if the manned submarine 100 runs for a long period of time, the oxygen concentration of the internal space of the viewing window 10 becomes low, and at this time, so as to maintain appropriate oxygen concentration in the internal space of the viewing window 10, oxygen is continuously supplied to the interior of the viewing window 10 through the oxygen supply system 70, thus allowing the passengers to stably breathe underwater.

If scuba diving experience is requested from the passengers during underwater viewing, on the other hand, the running of the manned submarine 100 stops, and after that, the passengers put on their scuba sets to allow them to conveniently enjoy the scuba diving experience, as shown in FIG. 6*g*.

If the underwater viewing and scuba diving experience are finished, as shown in FIG. 6*h*, the buoyancy of the buoyancy bags 41 is increased through the ascending and descending system 40, thus allowing the manned submarine 100 to be located above water to get off the passengers and completing the underwater viewing and experience.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A manned submarine for underwater viewing and experience having a body on which a forecastle and a poop are formed and a crew room formed on the top portion of the body to allow crew members and passengers to get thereinto, the manned submarine comprising:

a viewing window through which an outside view is seen disposed above the body so as to be spaced apart from the body, the viewing window having an internal space thereinto and being open in the lower portion thereof;

an oxygen supply system to supply oxygen to the internal space to prevent invasion of water and to enable the crew members and the passengers to stably breathe underwater;

fixing means adapted to firmly fix the viewing window to the body;

propulsion systems adapted to provide a propelling force to the body;

an ascending and descending system configured to allow the manned submarine to ascend on the water or to descend under the water;

a control box disposed at the forecastle of the body to control operations of the propulsion systems and the ascending and descending system; and wherein each fixing means comprises: an inside frame disposed along an inner surface of the viewing window and having one end fixed to one side of the body and other end fixed to other side of the body, the inside frame having support protrusions formed protrudingly on outside surface thereof so as to come into contact with a lower portion of the viewing window and to support the viewing window there against; and an outside frame disposed along an outer surface of the viewing window and having one end fixed to one side of the body and other end fixed to the other side of the body, the outside frame being laminated on the inside frame so as to prevent the viewing window supported by the inside frame from being separated from the body.

2. The manned submarine according to claim 1, wherein each propulsion system comprises:

a driving motor configured to provide a rotary force;

a propeller rotated by the rotary force received from the driving motor;

a casing into which the driving motor and the propeller are embedded;

a rotary shaft having one end connected to the casing and other end connected to the body;

a pinion gear located at one end of the rotary shaft to be rotated together with the rotary shaft;

a rack gear geared with the pinion gear to rotate the pinion gear; and a rotating cylinder having a rod coupled to one end of the rack gear to move the rack gear forward and backward; and wherein at least one or more propulsion systems are disposed on both sides of the body, respectively, and the driving motor and the rotating cylinder of each propulsion system are operated by the control of the control box.

3. The manned submarine according to claim 1, wherein the oxygen supply system is configured to measure an oxygen concentration at an interior of the viewing window and to supply oxygen to maintain an appropriate oxygen concentration, thus allowing the crew members and the passengers in the crew room formed on the top portion of the body to stably breathe underwater, the oxygen supply system comprising: an oxygen concentration measuring sensor disposed inside the viewing window to measure the oxygen concentration at the interior of the viewing window and to transmit a measured information to the control box; a second oxygen tank configured to supply the oxygen to the interior of the viewing window; an oxygen discharge tube configured to communicate with the second oxygen tank and discharge the oxygen supplied from the second oxygen tank to the interior of the viewing window; and an opening/closing valve disposed on the oxygen discharge tube to determine whether the interior of the oxygen discharge tube is open or closed, the opening/closing valve operable by the control of the control box.

* * * * *